United States Patent [19]

Sutton et al.

[11] Patent Number: 4,773,880

[45] Date of Patent: Sep. 27, 1988

[54] CIRCUIT MODULE FOR MULTI-PIN CONNECTOR

[76] Inventors: Christopher Sutton, 3749 Calle Casino, San Clemente, Calif. 92672; Richard Colburn, 22350 Cheraw Dr., Saugus, Calif. 91350

[21] Appl. No.: 43,619

[22] Filed: Apr. 28, 1987

[51] Int. Cl.[4] ..... H01R 13/66

[52] U.S. Cl. ..... 439/620; 333/185

[58] Field of Search ..... 333/181–185; 439/620, 608

[56] References Cited

U.S. PATENT DOCUMENTS

| | | | |
|---|---|---|---|
| 3,742,420 | 6/1973 | Harnden, Jr. | 361/56 |
| 3,743,996 | 7/1973 | Harnden, Jr. | 361/56 |
| 4,365,282 | 12/1982 | Brainard | 361/56 |
| 4,506,238 | 3/1985 | Endoh et al. | 333/138 |
| 4,560,963 | 12/1985 | Sharpe | 333/172 |
| 4,582,385 | 4/1986 | Couper et al. | 439/620 |

FOREIGN PATENT DOCUMENTS

| | | | |
|---|---|---|---|
| 0091867 | 10/1983 | European Pat. Off. | 439/620 |
| 2279236 | 2/1976 | France | 439/620 |

*Primary Examiner*—Gil Weidenfeld

*Assistant Examiner*—Gary F. Paumen

*Attorney, Agent, or Firm*—Price, Gess & Ubell

[57] ABSTRACT

Connectors with capacitors or resistors built in are very expensive and a custom design requires a considerable lead time. By building a circuit in modular form so that it connects to a standard cylindrical connector, both the cost and lead time are reduced drastically. Modules containing a variety of frequently used circuitry can be kept in inventory for at-will and immediate association with any standard circular connector, as desired. By having a variety of adapter collars in stock that mate with various kinds and constructions of cylindrical connectors, the suppression modules may be connected to a variety of differently constructed connectors. Many different configurations for the electrical circuitry in the module are possible. Many different configurations of the circuit module and interface collar are possible and can be designed to accommodate almost any connector configuration. By utilizing a terminating module as well, the connector with its circuit module attached can be utilized like and appears to be a single connector. A metal oxide varistor in compact plate form is uniquely suited for use in multi-pin connector bodies or in circuit modules.

17 Claims, 13 Drawing Sheets

CIRCUIT MODULE FOR MULTI-PIN CONNECTOR

BACKGROUND OF THE INVENTION

1. Field of the Invention

The present invention relates generally to improvements in multiple pin circuit connectors and more particularly pertains to new and improved multiple pin circuit connectors that are utilized for military applications to connect multi-conductor cable to electronic equipment.

2. Description of the Prior Art

Multi-pin connectors such as are utilized in airborne and military environments must be constructed to withstand considerable physical shock and mechanical strain. Many of these environments also demand highly miniaturized electronic circuitry. This need for miniaturization has caused some multi-pin connector manufacturers like Bendix Products, for example, to incorporate filter devices in the connector shell. Any connector with electronic circuitry incorporated within its housing must withstand the same severe mechanical forces as standard connectors. The circuitry utilized thereby tends to be very expensive. The connector becomes essentially a custom-made product. In addition, the connector becomes a throw-away item if the electronic circuitry within it fails for any reason. Accordingly, industry practice in the main, is to utilize standard connectors and place a filter and other circuitry in with the electronics package. Although the desirability of placing circuitry in a multi-pin connector has been felt in the connector industry for many years, the problems and expense associated therewith have prevented widespread adoption of that path. The present invention provides an elegant solution for that problem, as well as solving the problems associated with the present-day circuit connectors.

SUMMARY OF THE INVENTION

A circuit module designed to structurally interface with a multi-pin connector provides for an inexpensive filter connector that can be quickly assembled and easily and quickly modified or repaired, as needed. Use of an adapter collar to structurally connect the circuit module to the connector housing provides the flexibility of attaching the module to a variety of structurally different connectors. By utilizing the modular construction, a wide variety of circuitry, having any number of functions, may be connected to any assortment of pins in the connector thereby providing a connector that not only is less expensive and faster to make, but also has highly increased functional capabilities. A metal oxide varistor for surge suppression is uniquely suited for use in the circuit modules or in the connector body itself by reason of its construction in a compact plate form.

BRIEF DESCRIPTION OF THE DRAWINGS

The exact nature of this invention, as well as its objects and advantages will be readily apparent from consideration of the following specification relating to the accompanying drawings in which like-referenced numerals designate like parts throughout the figures thereof and wherein.

DESCRIPTION OF THE PREFERRED EMBODIMENTS

Figure 1:
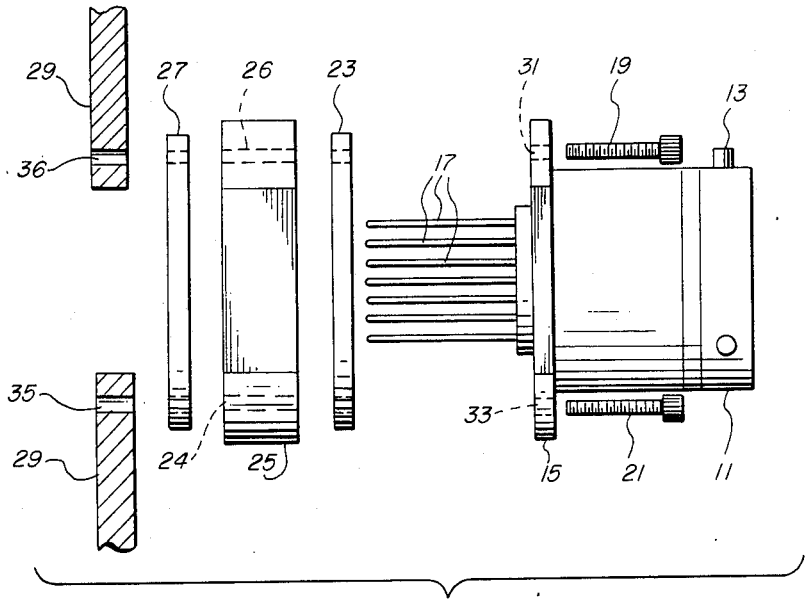
FIG. 1 is an exploded view of a multi-pin connector utilized in conjunction with a circuit module according to the present invention.
Figure 2:
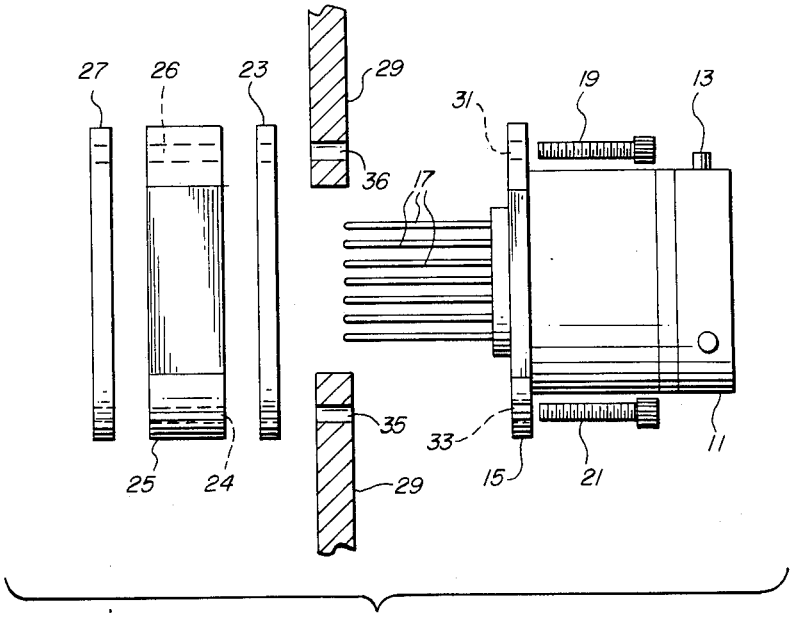
FIG. 2 is an exploded view of a multi-pin connector utilized in conjunction with a circuit module according to the present invention.

FIGS. 1 and 2 illustrate in exploded fashion the mounting of a circuit module according to the present invention in physical and electrical proximity to one-half of a multi-pin connector 11 which is mounted to a support plate 29 of an electronic avionics package, for example. The circuit module 25 may be mounted either on the exterior side of the support plate 29 as shown in FIG. 1 or at the interior side of support plate 29 as shown in FIG. 2. Generally the circuit module is sealed to the support plate 29 on one side and to the multi-pin connector 11 on the other side by a pair of EMI gaskets 27 and 23 respectively.

In the instance where the circuit module 25 is located on the interior side of mounting plate 29 (FIG. 2), gasket 23 mounts to the interior of mounting plate 29. Flange 33 of multi-pin connector 11 mounts to the exterior side of mounting plate 29. Gasket 27 may be utilized for termination modules as will be explained hereinafter.

The multi-pin connector 11 is essentially a standard cylindrical connector of the type sold by Bendix, ITT Cannon and other connector companies. The connector has a circular body. It is essentially made in two parts, a female half and a male half. The two halves precisely fit together by guiding studs 13 and grooves. They may threadably fasten together by a threaded collar.

As shown in FIGS. 1 and 2, the female half of the connector is mounted to support plate 29 through the circuit module 25 of the present invention by way of mounting screws 19 and 21. The female half of connector 11 has a mounting flange 15 which has a pair of through-holes 31 and 33 therein for passing the mounting screws 19 and 21 respectively. Electrical contact between the female sockets in connector 11 (not shown) and the circuitry contained within the structure of support plate 29 is by way of conductors 17.

In the case where the circuit module 25 is mounted on the outside of support plate 29, mounting screws 19 and 21 pass through mounting flange 15 of connector 11 through aperatures in gasket 23, aperatures 24 and 26 in circuit module 25, aperatures in gasket 27 and aperatures 35 and 36 in mounting plate 29. The entire unit is held by, for example, nut threaded onto mounting bolts 19 and 21 respectively.

In the case where the circuit module 25 is mounted on the inside of support plate 29, the mounting bolts 19 and 21 pass through the aperatures 35 and 36 in the support plate 29 before they pass through the aperatures in the gaskets 23, 27 and the circuit module 25.

Figure 3:
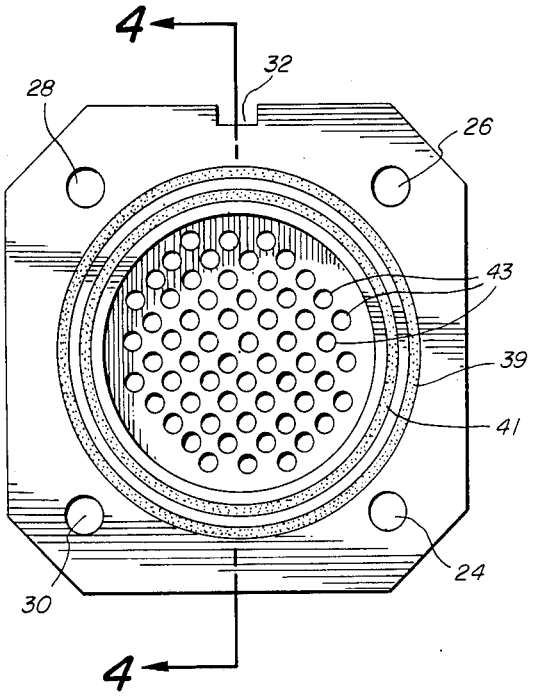
FIG. 3 is a front plan view of a circuit module according to the present invention.
Figure 4:
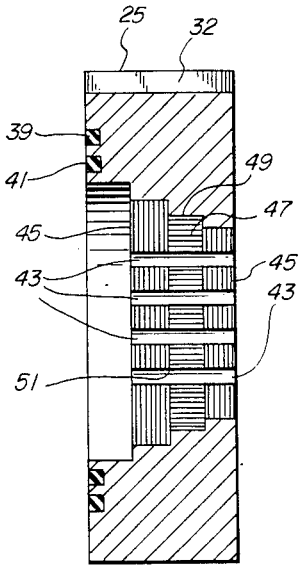
FIG. 4 is a cross-sectional view of FIG. 3 taken along lines for 4—4.

Referring now to FIGS. 3 and 4, the preferred structure of a circuit module according to the present invention is illustrated in more detail. Circuit module 25 is shown as being generally rectangular with mounting holes 24, 26, 28 and 30 located on the flange. A pair of seals 39 and 41 are located around the socket or pin cluster 43. Gasket 39 is preferably an environmental O-ring seal. Gasket 41 is preferably an EMI/RFI gasket. The cluster 43 which aligns with the pins 17 of the connector 11 (FIG. 1 and FIG. 2) can be spring sockets which receive and mate with their respective pins 17. Circuit module 25 is preferably keyed by a key slot 32 to permit visual alignment of the circuit module with its connector.

The circuit array 47 is mounted within the body of the circuit module as shown in the cross-section of FIG. 4. It is held in place by a potting compound 45 on both sides thereof. The circuit array 47 is connected to the individual spring sockets passing through the array by medium temperature solder joints 51. In addition, the circuit array 47 is connected to the body of the circuit module by low temperature solder joints 49.

Circuit array 47 can be any number of circuits as desired, including but not limited to feed-through capacitors and filters, broadband low pass filters in L and Pi configurations, as well as others. These circuits may contain structure for electro-magnetic pulse suppression to prevent passage of damaging surges. These functions are provided by circular discoidal arrays and other plates. The arrays may be metalurgically soldered in place in the circuit module. The module is grounded and sealed by ceramic/metallic compatible semi-rigid epoxy on both sides as shown in FIG. 4.

Figure 5:
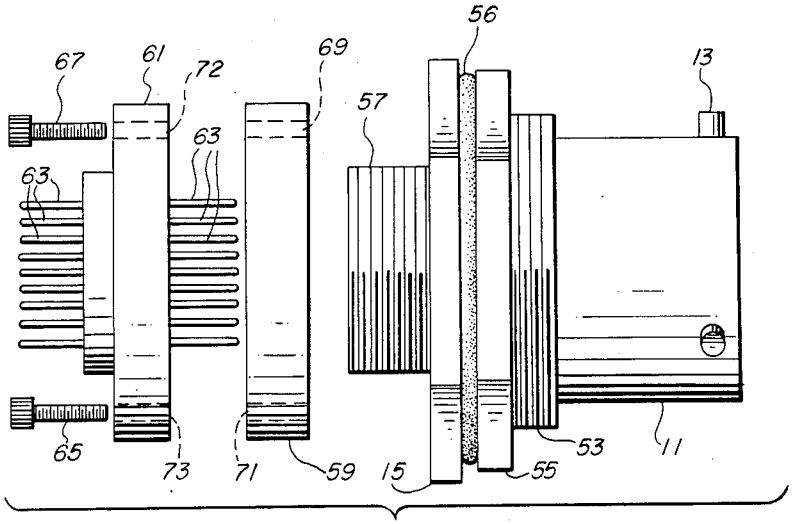
FIG. 5 is an exploded view of a multi-pin connector utilized with a circuit module and an adapter collar according to the present invention.

Referring now to FIG. 5, an alternate preferred embodiment of the present invention is illustrated wherein a circuit module 61 is utilized in combination with an adapter collar 59 as a means of attachment to the multi-pin connector 11. Multi-pin connector 11 as shown in FIG. 5 is a female half having locating studs 13 located on the outside of its barrel. The barrel, in addition, has external threads 53 thereon, upon which is threaded a fastening bolt 55 that threads towards mounting plate 15. An O-ring sealing washer 56 is recessed within mounting plate 15.

Multi-pin connector 11 would be fastened to a mounting surface that would be held between mounting plate 15 and fastening nut 55 with the O-ring 56 sealing mounting plate 15 thereto. On the other side of mounting plate 15 a threaded barrel is integral with mounting plate 15. A plurality of wire receptacles are located within barrel 57.

The adapter ring 59, according to the present invention, as will be more fully explained hereinbelow, threadably engages barrel 57 and is tightened down thereon until it firmly abutts the other side of mounting plate 15. Adapter ring 59 has a plurality of threaded holes 69, 71 therein and may contain a set screw (not shown) to lock adapter ring 59 to threaded barrel 57.

The circuit module 61, according to the present invention, has a body within which the circuit components are sealed. A plurality of connector pins 63 pass through the sealed circuit components at both sides thereof.

The circuit module 61 has a plurality of aperatures 72 and 73 therein to allow mounting bolts 67 and 65 to pass through and into the threaded mounting holes 69 and 71 in adapter ring 59. The pins 63 coming out the connector 11 side of circuit module 61 extend into and engage the pin receptacles within barrel 57 of connector 11.

Figure 6:
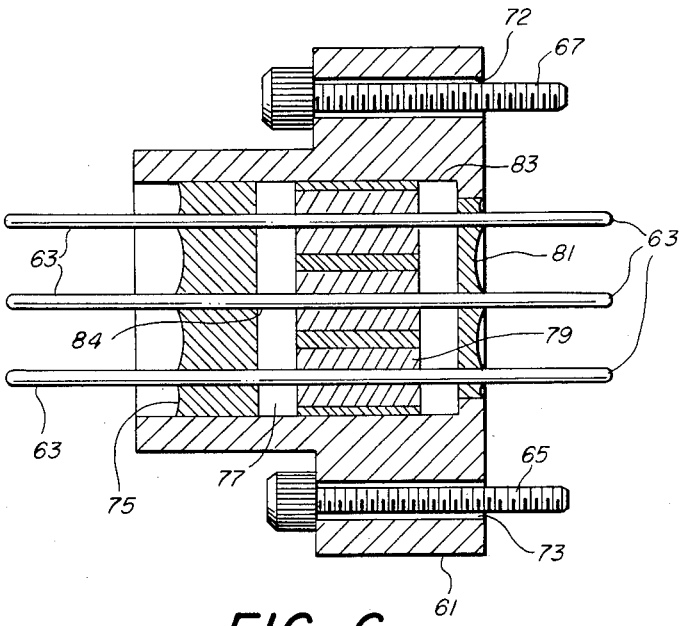
FIG. 6 is a cross-section of a circuit module according to the present invention.

Referring now to FIG. 6 the inner workings of the circuit module is illustrated. The circuit module 61 preferably has an aluminum or steel housing which may be plated as required by military specifications. The body of the module 61 has a pair of aperatures 72, 73 therethrough. A pair of capscrews 65, 67 are inserted into these aperatures to fasten the circuit module to the adapter ring 59 in a manner explained hereinabove. The circuit components are located within the body of the circuit module 61. These components, for example, may be a discoidal capacitor 77 and a plurality of ferrite bead segments 79 around each of the pins 63 which pass through the circuit module 61. The discoidal capacitor and ferrite bead material is contained by layers of semi-rigid potting compound on the top 75 and bottom sides 81 of the circuit module 61. The discoidal capacitor is soldered 83 to the body, preferably with a high temperature reflow solder. Each of the pins are preferably gold-plated. They are soldered to the discoidal capacitor 77 at 84 with solder, that is a high temperature reflow.

The adapter ring 59 (FIG. 7) is preferably electro-tin plated aluminum or steel. It contains at least a pair of threaded mounting holes 69, 71 that receive capscrews 67 and 75. Adapter ring 59 has a threaded internal aperature therethrough which is sized to thread over a threaded barrel 57 (FIG. 5) of connector 11.

For those connectors that do not have an externally threaded barrel, but utilize an internally threaded barrel, the adapter ring 87 (FIG. 8) may be used. The only difference between the adapter ring 87 and adapter ring 59 is that the adapter ring 87 has an externally threaded barrel 93, instead of an internally threaded aperature 85.

Figure 7:
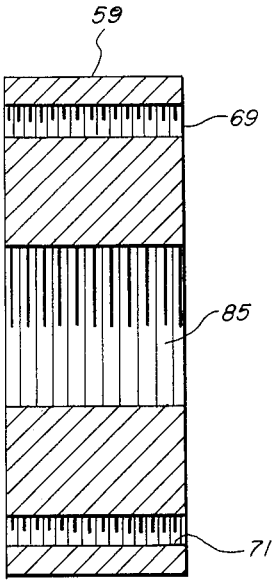
FIG. 7 is a cross-section of an adapter collar according to the present invention.
Figure 8:
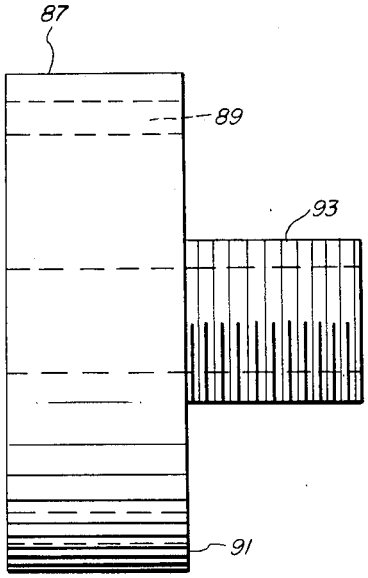
FIG. 8 is a plan view of an alternate adapter collar according to the present invention.
Figure 10:
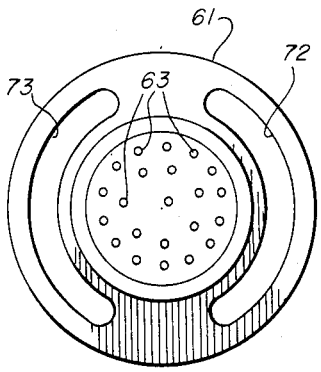
FIG. 10 is a right end view of the circuit module of FIG. 9.
Figure 9:
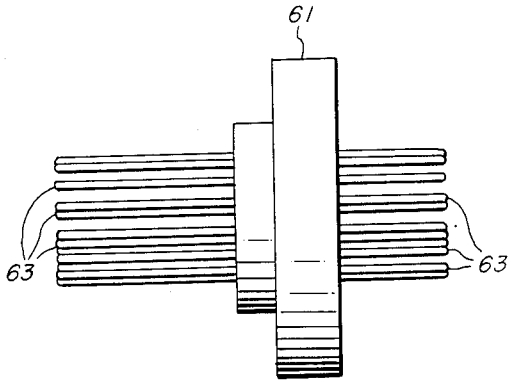
FIG. 9 is a plan view of an alternate circuit module according to the present invention.

The circuit module 61 (FIGS. 5, 9 and 10) which mounts to the adapter rings of FIGS. 7 and 8 utilizes a pair of slotted aperatures 72 and 73 to allow for alignment with respect to the connector 11.

Figure 11:
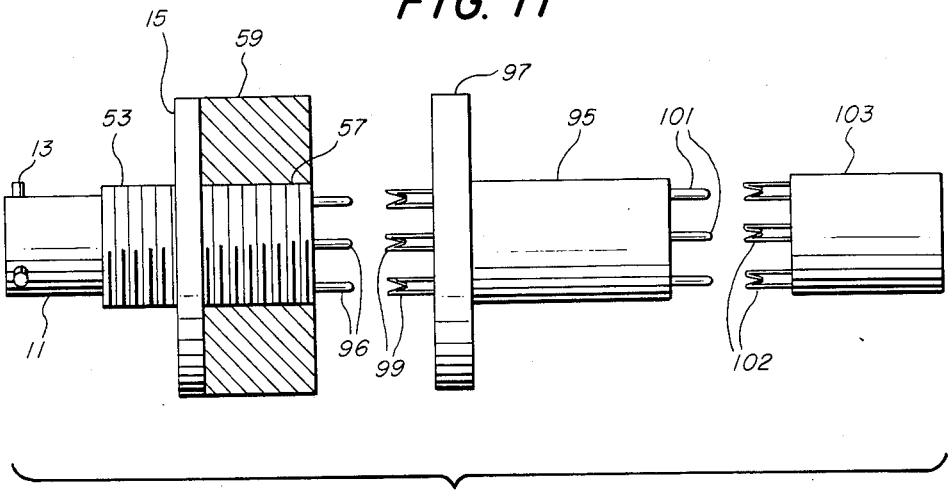
FIG. 11 is an exploded view partially in section of a circuit module adapter collar and termination module according to the present invention utilized for the multi-pin connector.

Referring now to FIG. 11, another preferred embodiment of the present invention is illustrated as further including a termination module 103. An adapter ring 59 and the circuit module 95 with a mounting plate 97 fasten together. The mounting plate 97 attaches to adapter ring 59 by a convenient fastening means, such as cap screws, for example. Termination module 103 attaches to the pins 101 coming out of one end of the circuit module 95.

FIG. 11 also illustrates a different connection mechanism between the pins 96 and the circuit module 95. The pins 96 may, for example, can be flex circuit tails that fit within grasping connectors 99. The terminating module 103 has these grasping connectors 102 that receive and make electrical contact with pins 101 extending from the circuit module 95. The termination module provides for easy electrical connection to the circuit module 95 by convenient connector mechanisms such as a crimp contact, for example.

Figure 12:
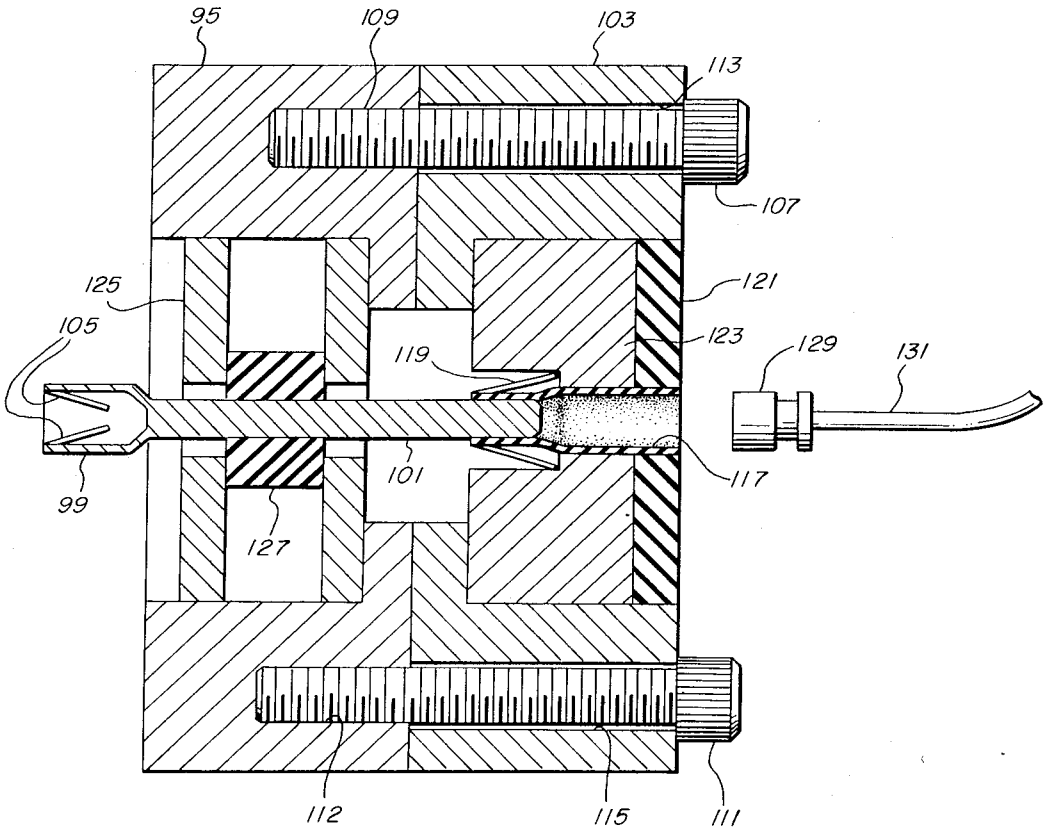
FIG. 12 is a cross-sectional view of a termination module and circuit module according to the present invention.

The physical relationship between the circuit module 95 and the termination module 103 is illustrated in FIG. 12. The termination module 103 is shown as physically held to the circuit module 95 by means of capscrews 107 and 111 that pass through aperatures 113 and 115 respectively in termination module 103 and threadably engage threaded recesses 109 and 112 respectively in the circuit module body 95.

The pin 101 of circuit module 95 which has a receiving receptacle 99 passes through the circuit module 95 through circuit element 127 which is sealed therein by barriers 125 as explained above. The grasping spring biased element 105 of receptacle 99 receives the wire contacts from the connector.

The pin 101 passes through to termination module 103 and makes contact with a device that is designed to receive a crimped wire end 129.

This connector sleeve device 117 consists of a conductive sleeve having grabbing extensions 119 therein which abutt against the sides of and are retained by a silicon rubber block insert 123 so that it may not be removed by pulling the crimp insert 129 out. The silicon rubber block insert 123 may be a standard military specification compound and design.

The wire 131 to be connected to pin 101, in this instance, is connected by a crimped wire contact 129. The contact 129 fits within connector sleeve 117 and over the end of pin 101 causing the end of conductive sleeve 117 at pin 101 to deform into the space left by the monoblock 123. The connection is simply a press fit which may be released.

Figure 13:
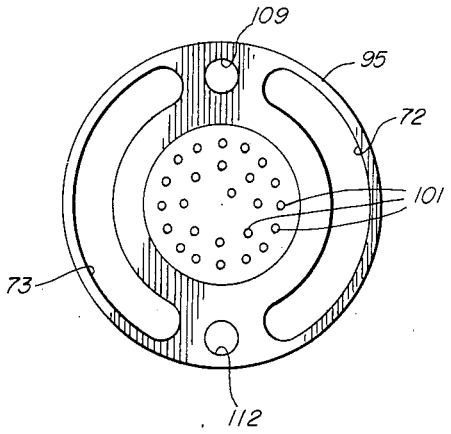
FIG. 13 is a right end view of a circuit module according to the present invention.
Figure 14:
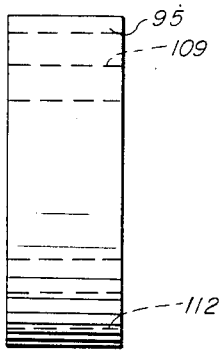
FIG. 14 is a side view of the module of FIG. 13.

The filter module 95 as illustrated in an end view in FIG. 13 is shown as having a plurality of slotted aperatures 72, 73 therein besides a pair of threaded aperatures 109 and 112. The threaded aperatures receive the capscrews that pass through the aperatures in the termination module 103. The slotted aperatures 72, 73 receive capscrews that pass through the circuit module 95 and thread into the adapter ring.

Figure 15:
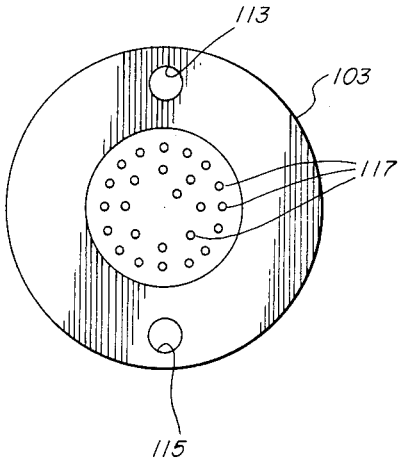
FIG. 15 is a right end view of a termination module according to the present invention.
Figure 16:
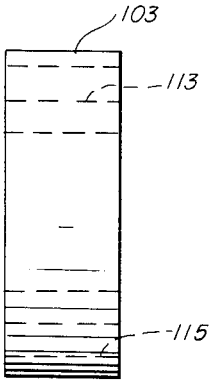
FIG. 16 is an side view of the termination module of FIG. 15.

FIG. 15 illustrates the termination module 103 with a plurality of crimp wire receptors 117 and a pair of aperatures 113 and 115 for receiving the capscrews that hold the termination module to the circuit module.

As can be seen from the prior discussion of the structure of the present invention, the invention contemplates a building block approach to the concept of adding desirable electronic functions to a multi-pin connector. This building block approach is quite unique in the multi-pin connector field. The result of this approach is to provide a multi-pin connector that may have any number of circuit functions associated with it and that can be quickly assembled and easily and quickly modified or repaired as needed. All of this can be accomplished at a dramatically reduced cost and lead time as compared to the custom connectors which contain certain circuit functions within their housings.

Figure 17:
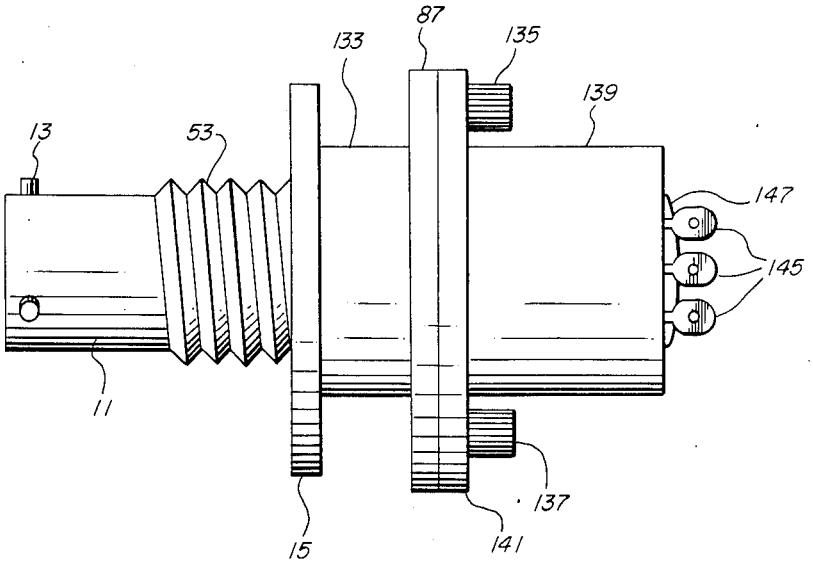
FIG. 17 is a plan view of a multi-pin connector having a circuit module according to the present invention attached thereto.
Figure 18:
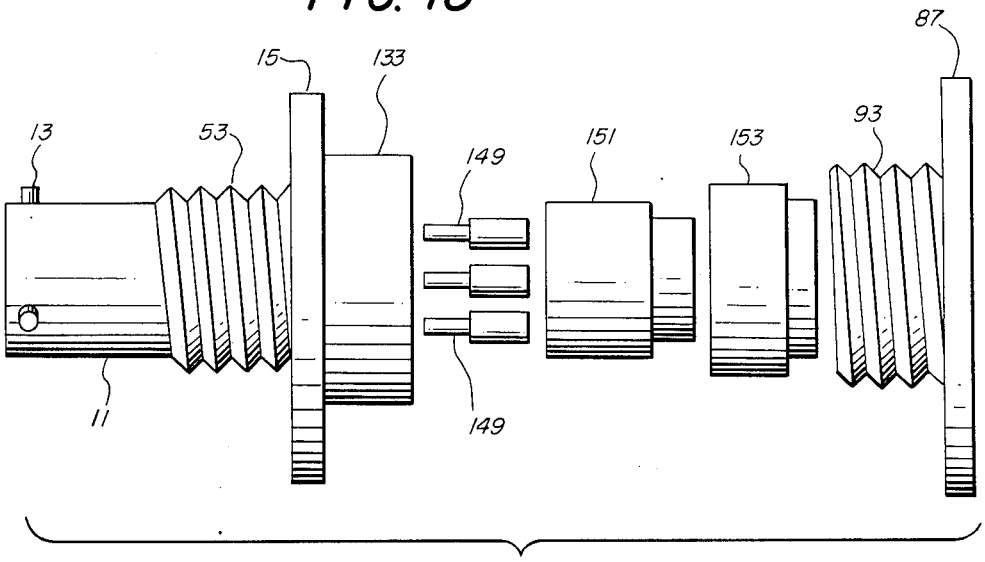
FIG. 18 is an exploded view of a multi-pin connector of FIG. 17 and an adapter ring according to the present invention.

A variety of structures are possible within the framework of the present invention. FIGS. 17–21, for example, show another preferred embodiment of the present invention. FIG. 17 illustrates a connector 11 having fastening threads 53 thereon adjacent to a mounting plate 15. The connector has a barrel 133 with internal threads therein and contacts to which is mounted a connector ring 87 having a barrel with external threads 93 that mate with the internal threads in barrel 133. A circuit module 139 is fastened to mounting 87 by way of capscrews 135, 137 passing through the circuit modules' mounting plate 141. The other end of the circuit module is potted with an appropriate potting material 147 and has a plurality of connector pins 145.

Internally (FIG. 18) a plurality of pin receptacle contacts 149 are soldered into the existing solder cup contacts within the barrel 133 of connector 11. The existing open wire seal 151 and the existing pressure plug 153 are installed and torqued down by the adaptor ring 87 which threadably engages internal threads (not shown) of barrel 133 in connector 11 by way of the external threaded barrel 93.

Figure 21:
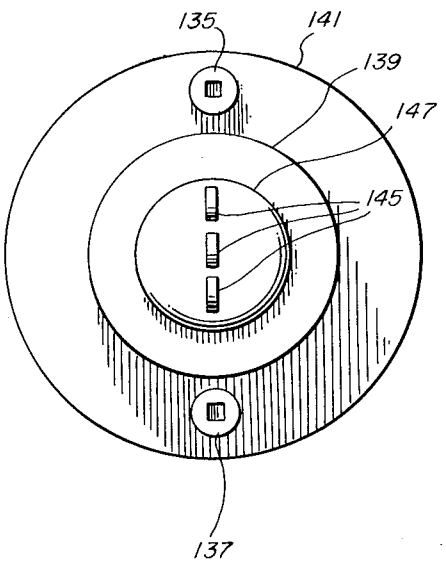
FIG. 21 is a right-end view of the module in FIG. 19.
Figure 19:
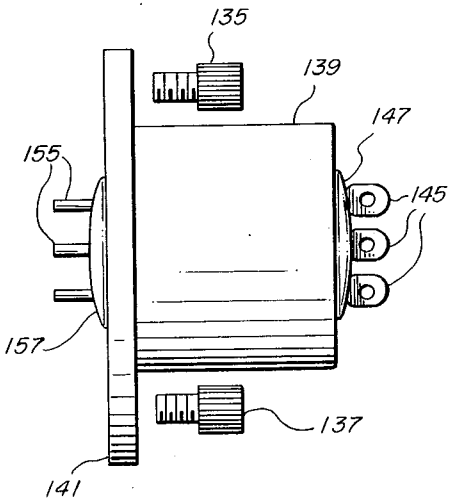
FIG. 19 is a plan view of a circuit module according to the present invention.
Figure 20:
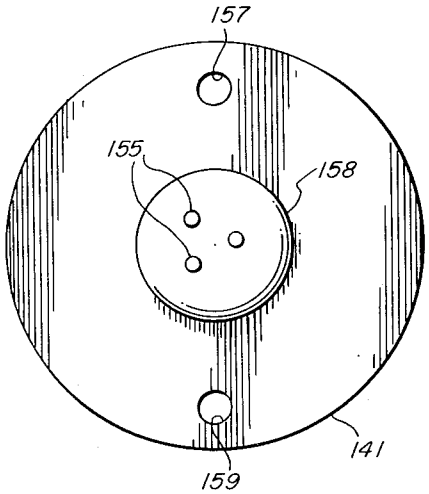
FIG. 20 is a left-end view of the module in FIG. 19.

The circuit module 139 is more clearly illustrated in FIGS. 19–21. The module 139 is retained by module retention capscrews 135 and 137 that pass through the mounting flange 141. The pins 155 that extend from the module insert into the pin receptacle contacts 149 that was soldered into and are part of the connector 11. The capscrews 135 and 137 pass through aperatures 157 and 159 respectively in the mounting flange 141. The pins 155 are sealed by a glass/metal seal 158. The wire soldering eyelets 145 on the side of the circuit module opposite to the pins 155 are also sealed by appropriate sealing material 147.

The type of circuitry that may be carried by the circuit module of the present invention is virtually unlimited. Presently, preferred circuitry is circuitry that provides the electrical functions of filtering, electro-magnetic pulse suppression, lightening protection, termination, and balance, as well as delay line functions. All these functions can be accomplished by modular plates that are unique to the present invention. These plates contain electronic devices that are installed in the body of the circuit module. Because these plates are installed within the body of the circuit module and are sealed, they are ruggedized. This structure reduces the stress levels across the surface of the plate and limits the problems of fracture occasioned by handling and the brittle nature of the various materials that must be utilized.

Plate construction, for example, may utilize substrate materials of alumina, zinc oxide, barium titanate, ferrite, flexible polymer and rigid polymer.

Figure 31:
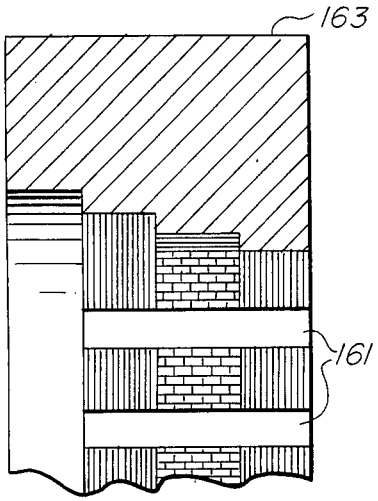
FIG. 31 is a half cross-section of a circuit module according to the present invention containing certain circuitry therein.
Figure 32:
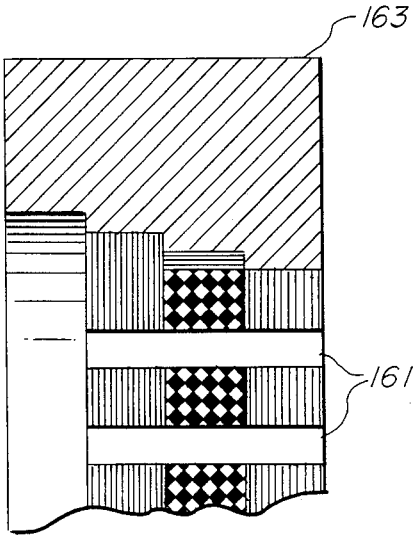
FIG. 32 is a half cross-section of a circuit module according to the present invention containing certain circuitry therein.
Figure 33:
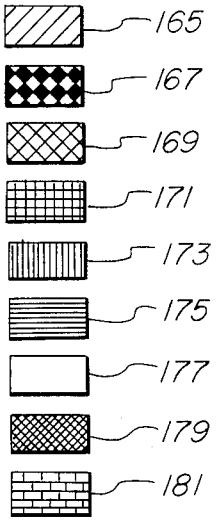
FIG. 33 is a materials identification chart that relates to the symbols utilized in FIGS. 22 through 32.

FIGS. 22–33 illustrate in half cross-section a variety of electronic devices that are constructed by use of the modular plates according to the present invention. FIG. 33 is a material legend that illustrates the layers of material within the body 163 of the circuit module. Each figure illustrates the material around a single pin 161 of the circuit module within the body 163.

To understand what materials are represented by the FIGS. 22–32, one should refer to FIG. 33. The material illustrated by the legend 165 is the adapter housing material. Legend 167 illustrates a zener diode plate. Legend 169 illustrates a metal oxide varistor plate. Legend 171 illustrates a capacitive plate. Legend 173 illustrates epoxy. Legend 175 illustrates a solder joint. Legend 177 illustrates a spring socket. Legend 179 illustrates a ferrite plate. Legend 181 illustrates any other plate that may be desired.

Figure 22:
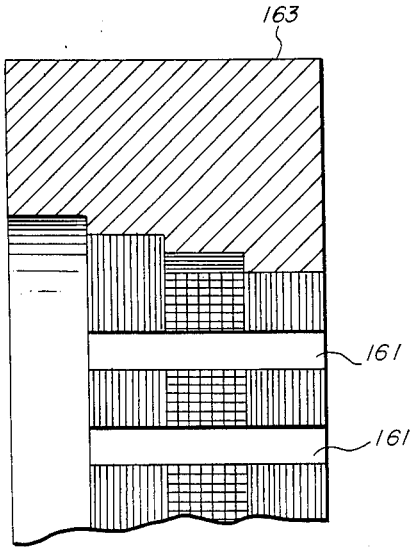
FIG. 22 is a half cross-section of a circuit module according to the present invention containing certain circuitry therein.

Referring now to FIG. 22 and utilizing the legend in FIG. 33, one can see that a spring socket 161 has around it from left to right of the figure, a layer of epoxy, a capacitive plate, and another layer of epoxy. The capacitive plate is connected to the adapter housing 163 by a solder joint. This particular circuit is called a feedthrough filter which is a parallel to a ground capacitive device.

Figure 23:
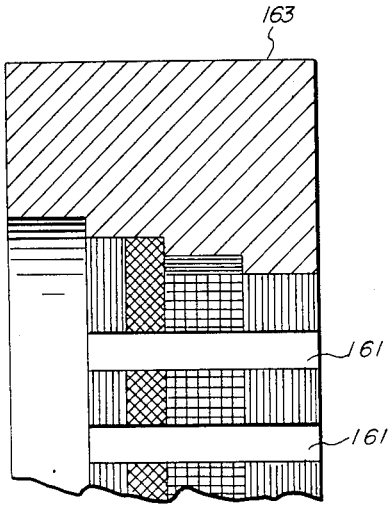
FIG. 23 is a half cross-section of a circuit module according to the present invention containing certain circuitry therein.

FIG. 23 is an illustration of an L-section filter which is a parallel to ground capacitive device and in-line series inductive device with the inductive element on the input side.

Figure 24:
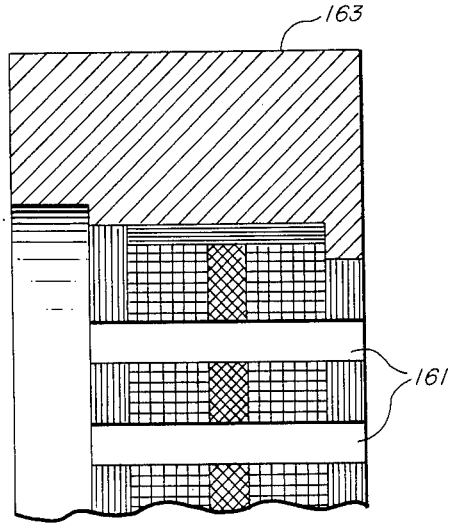
FIG. 24 is a half cross-section of a circuit module according to the present invention containing certain circuitry therein.

FIG. 24 is a Pi-section filter which is a parallel-to-ground multiple capacitive device and in-line series inductive device.

Figure 25:
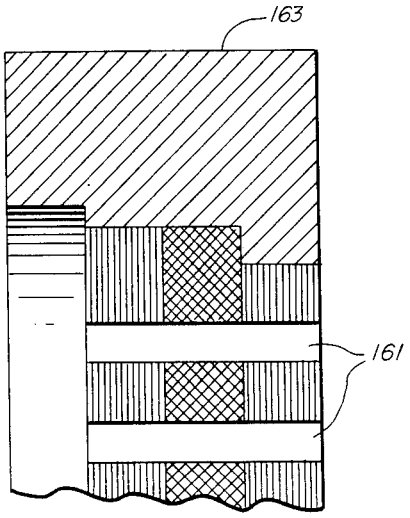
FIG. 25 is a half cross-section of a circuit module according to the present invention containing certain circuitry therein.

FIG. 25 is an inductive suppressor filter which is a parallel-to-ground capacitive device and multiple in-line series inductive device.

Figure 26:
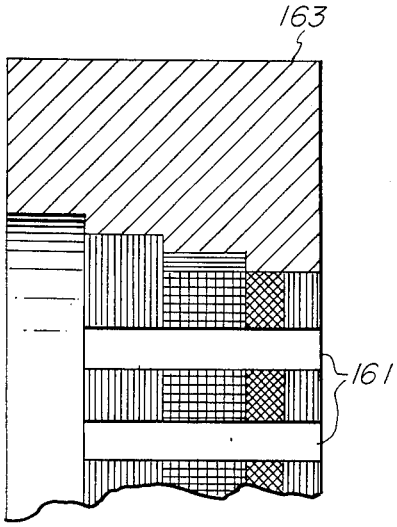
FIG. 26 is a half cross-section of a circuit module according to the present invention containing certain circuitry therein.

FIG. 26 is a reverse L-section filter which is a parallel-to-ground capacitive device and in-line series inductive device where the inductive element on the output side.

Figure 27:
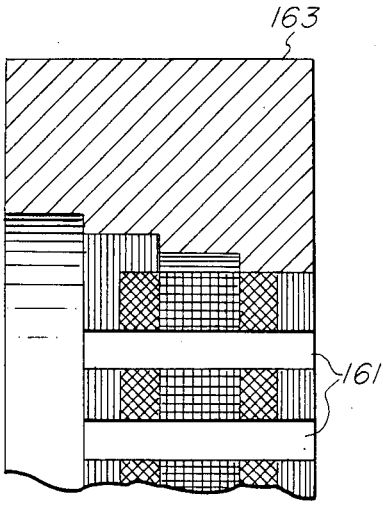
FIG. 27 is a half cross-section of a circuit module according to the present invention containing certain circuitry therein.

FIG. 27 is another inductive suppressor filter.

Figure 28:
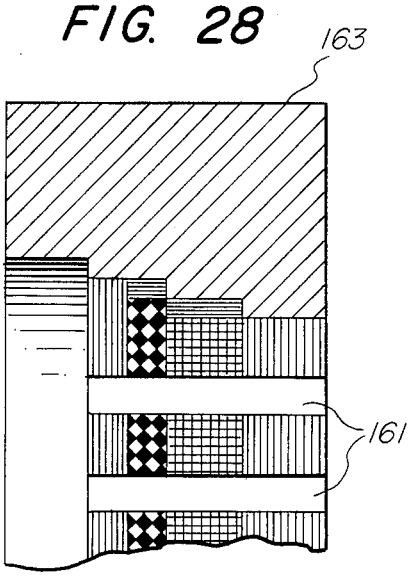
FIG. 28 is a half cross-section of a circuit module according to the present invention containing certain circuitry therein.

FIG. 28 is a feedthrough filter with a metal oxide varistor section which is a parallel-to-ground metal oxide varistor.

Figure 29:
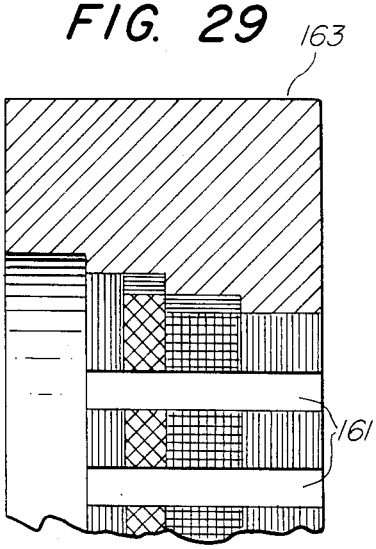
FIG. 29 is a half cross-section of a circuit module according to the present invention containing certain circuitry therein.

FIG. 29 is a feedthrough filter with a zener diode which is a parallel-to-ground zener diode.

Figure 30:
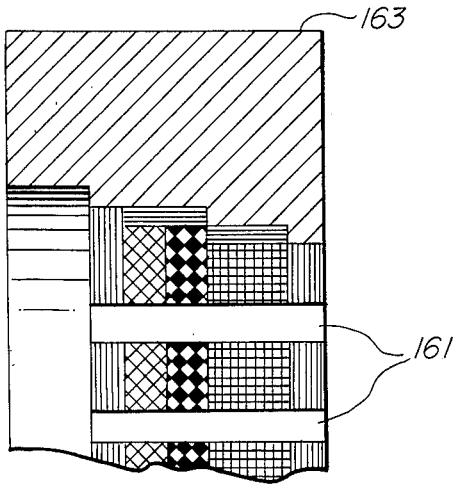
FIG. 30 is a half cross-section of a circuit module according to the present invention containing certain circuitry therein.

FIG. 30 is a feedthrough filter with a metal oxide varistor and zener diode.

FIG. 31 illustrates any other type of circuitry that may be utilized such as terminator circuitry, balance circuitry or delay-line circuitry.

FIG. 32 illustrates a lightening protection device which is simply a metal oxide varistor section that provides a parallel-to-ground metal oxide varistor.

Figure 39:
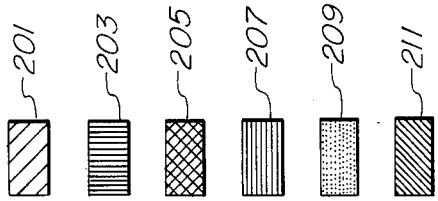
FIG. 39 is a material identification chart identifying the materials utilized in FIGS. 34 through 38.

A preferred metal oxide varistor modular plate construction that is specifically suited to the present circuit module, but may be utilized within the body of a multi-pin connector as well is illustrated in FIGS. 34–38. FIG. 39 is the material legend for FIGS. 34–38. The advantage of the present metal oxide varistor plate is that it is compact and may be implemented within a small housing such as the circuit module housing of the present invention. The plate may utilize one of the following base substrate materials: alumina, zinc oxide, rigid polymer and co-fired alumina/zinc oxide. The insulation barrier utilized to insulate the metal oxide varistor modular plate from adjacent plates and the environment may be any one of the following materials: rigid polymer, flexible polymer, solder mask or capton sheet.

One of the advantages of this type of modular plate is that additional specific electronic functions may be incorporated into the housing through the use of discreet electronic components that are mounted on the surface of the plate.

Referring now to FIG. 39 which illustrates the material legend of FIGS. 34–38, a legend 201 represents zinc oxide. Legend 203 represents metalization material. Legend 205 is solder. Legend 207 is the contact pin. Legend 209 is the insulation coating. Legend 211 is the carrier plate.

Figure 34:
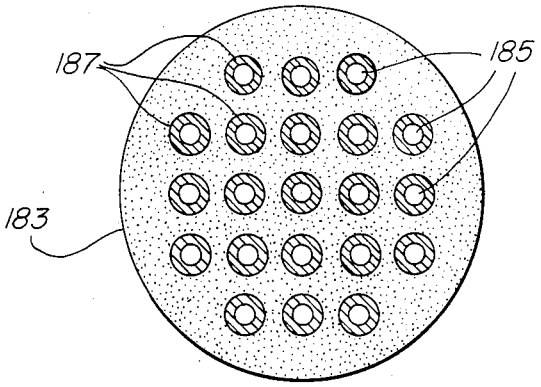
FIG. 34 is a bottom view of a module plate capable of an electronic function according to the present invention.

Referring then to FIG. 34, the bottom view 183 of the modular plate 191 is showing the insulation coating with the zinc oxide rings 187 around the through-holes 185 in the plate.

Figure 35:
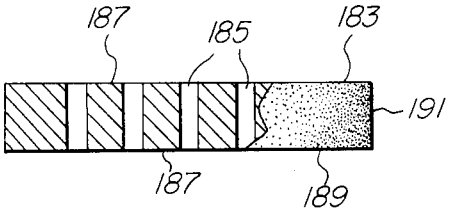
FIG. 35 is a side partially-broken-away view of the electronic plate.

Referring to FIG. 35, a partially broken away side view more clearly illustrates the through-holes 185 through the zinc oxide material 187 which is again covered on the side 191 by the insulation coating.

Figure 36:
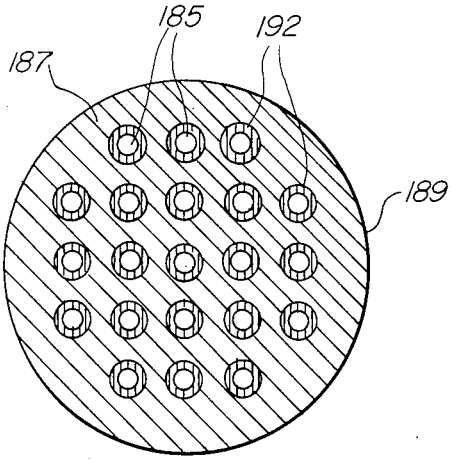
FIG. 36 is a top view of the electronic plate.

Referring now to the top 189, illustrated in FIG. 36, the zinc oxide material is again shown to have through-holes 185 therein with metalization shaped like doughnuts 192 around each one.

Figure 37:
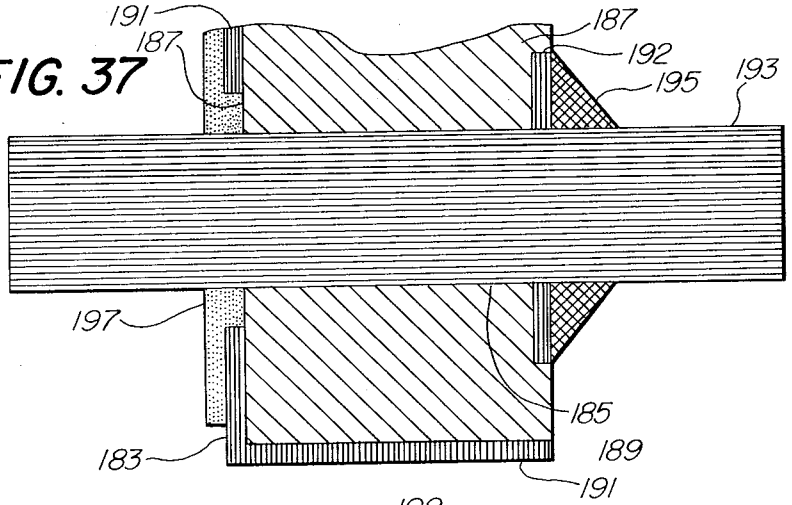
FIG. 37 is a partial end view and cross-section of one of the through-holes of the electronic plate of FIGS. 34–36.

Referring now to FIG. 37, a single through-hole 185 with a contact pin 193 inserted therein is illustrated as passing through a zinc oxide material 187. On one side of the plate a metalization doughnut 192 surrounds the through-hole to permit soldering of the contact pin 193 to the zinc oxide by way of the metalization material. On the other side of the plate, the metalization ground plane is shown along the edges 191 and on the other side 183. It does not contact the pin and effectively forms a doughnut around it. The entire backside is then covered with an insulation coating 197 that fills in the area between the metalization plate and the contact pin on the zinc oxide surface 187.

Figure 38:
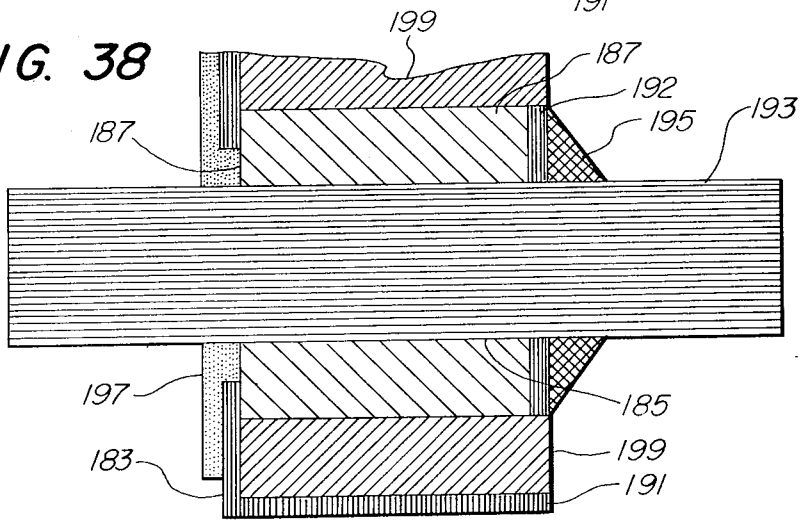
FIG. 38 is a partial end view and cross-section of one of the through-holes of the electronic plate for an alternate embodiment according to the present invention.

FIG. 38 illustrates a similar construction except that instead of the plate being made of solid zinc oxide, it simply has columns of zinc oxide 187 around each through-hole 185. These columns are carried by carrier plate material 199.

What has been described is a circuit module and discoidal circuit elements that may be inserted therein which are designed to structurally interface with a multi-pin connector to provide for an inexpensive filter connector that can be quickly assembled and easily and quickly modified or repaired as needed.

It should be understood, of course, that the foregoing disclosure relates only to the preferred embodiments of the invention and that numerous modifications may be made therein without departing from the spirit and the scope of the invention as set forth in the appended claims.

What is claimed is:

1. A modular circuit structure removably connectable to a multi-pin connector having two body halves, with male connectors in one body half and female connectors in the other body half, the modular circuit structure capable of withstanding severe shock and mechanical strain when connected to the multi-pin connector, said modular circuit comprising:

a rigid, impact resistance body structure adapted in size and shape to contain solid state electronic circuit elements;

solid state electronic circuit elements fixedly contained within said body structure and sealed from the external environment by potting compound;

contact means arranged integral with the circuit elements within said body structure and adapted to interconnect said circuit elements with the connectors of said multi-pin connector when said modular circuit structure is connected to said multi-pin connector;

a rigid, impact resistant adapter collar having a size and shape adapted to the external dimensions of one of the two body halves of said multi-pin connector, said adapter collar having threads which are threaded to said one of the two body halves, said adapter collar including means for receiving fastening means from said body structure; and detachable fastening means removably attachable to said adapter collar and said body structure for rigidly fastening said body structure to said adapter collar when said adapter collar is threadably attached to one of said two body halves;

whereby the body structure, when attached to said multi-pin connector by the adapter collar, can withstand the same shock and mechanical strain as the multi-pin connector.

2. The multi-pin connector of claim 1 wherein said circuit elements comprise devices that perform filter functions.

3. The multi-pin connector of claim 1 wherein said circuit elements comprise devices that provide surge protection.

4. The multi-pin connector of claim 3 wherein said surge protection circuitry comprises a Zener diode.

5. The multi-pin connector of claim 3 wherein said surge protection circuitry comprises a metal oxide varistor.

6. The multi-pin connector of claim 5 wherein said metal oxide varistor comprises a homogeneous plate of zinc oxide with holes for connector pins.

7. The multi-pin connector of claim 5 wherein said metal oxide varistor comprises a carrier plate with said zinc oxide beads therein, said plate having holes for connector pins in said areas of said zinc oxide beads.

8. The multi-pin connector of claim 1 wherein said circuit elements comprise solid state electronic devices that perform as an R-C delay line.

9. The multi-pin connector of claim 1 wherein said circuit elements comprise solid state electronic devices that perform as an L-C delay line.

10. The multi-pin connector of claim 1 wherein said adapter collar has an aperature therein with internal threads for threadably attaching to an external thread structure of said connector.

11. The multi-pin connector of claim 1 wherein said adapter collar has an aperature therein with a tube portion extending from said adapter collar coincident with the radial center of the aperature, said tube portion being externally threaded for threadably attaching to an internal thread structure of said connector.

12. The multi-pin connector of claim 1 further comprising:

a termination module for attaching to said circuit module at the end opposite to the end connected to the multi-pin connector, said termination module making electrical contact with at least one pin at its circuit module end and providing for wire connections at the end opposite the circuit module end.

13. The multi-pin connector of claim 1 wherein said circuit module includes wire connection means.

14. The modular circuit structure of claim 1 wherein said body structure further includes a plurality of apertures on the perimeter thereof.

15. The modular circuit structure of claim 14 wherein said means for receiving fastening means in said adapter collar comprises a plurality of internally threaded apertures.

16. The modular circuit structure of claim 15 wherein said detachable fastening means comprises a plurality of mounting bolts passing through the apertures in said body structure and threadably engaging the internally threaded apertures of said adapter collar.

17. The modular circuit structures of claim 1 wherein said contact means includes a plurality of contact pins extending through the body structure, said potting compound sealing around each contact pin.

* * * * *